US005493883A

United States Patent [19]

Myers

[11] Patent Number: 5,493,883

[45] Date of Patent: Feb. 27, 1996

[54] AXIAL PIN TUMBLER LOCK

[75] Inventor: Gary L. Myers, Monee, Ill.

[73] Assignee: Fort Lock Corporation, River Grove, Ill.

[21] Appl. No.: 308,702

[22] Filed: Sep. 19, 1994

Related U.S. Application Data

[63] Continuation-in-part of Ser. No. 835,145, Feb. 12, 1992, Pat. No. Des. 350,686.

[51] Int. Cl.[6] ..... E05B 9/08

[52] U.S. Cl. ..... 70/373; 70/370; 70/451; 411/180; 411/399

[58] Field of Search ..... 70/370, 373, 451, 70/466, 452; 411/180, 399, 185–189

[56] References Cited

U.S. PATENT DOCUMENTS

| | | | |
|---|---|---|---|
| 400,161 | 3/1889 | Balston | 70/229 |
| 1,480,650 | 1/1924 | Bacon | 70/370 |
| 1,894,708 | 1/1933 | Sardeson | 411/399 |
| 2,016,610 | 10/1935 | Moeller | 411/399 |
| 2,040,258 | 5/1936 | Jacobi | 70/370 |
| 2,093,038 | 9/1937 | Douglas | 70/370 |
| 2,949,142 | 8/1960 | Sumerak | 411/180 |
| 3,190,092 | 6/1965 | Patriquin | 70/373 |
| 3,600,912 | 8/1971 | Foreman . | |
| 3,722,565 | 3/1973 | Miller, Jr. et al. | 411/180 |
| 4,049,313 | 9/1977 | Lundberg . | |
| 4,325,237 | 4/1982 | Menzie . | |
| 4,628,713 | 12/1986 | Cecchi et al. . | |
| 4,689,978 | 9/1987 | Drummond . | |
| 4,792,166 | 12/1988 | Shiraishi et al. | 292/36 |
| 4,820,235 | 4/1989 | Weber et al. | 411/399 |
| 4,910,982 | 3/1990 | Dana | 70/370 |
| 5,056,344 | 10/1991 | Bartczak | 70/452 |
| 5,222,850 | 6/1993 | Medal | 411/180 |

OTHER PUBLICATIONS 2 pages from Fort Lock Catalog No. 12.

*Primary Examiner*—Darnell M. Boucher
*Attorney, Agent, or Firm*—Leydig, Voit & Mayer

[57] ABSTRACT

A lock shell comprising a tubular outer shell for receiving lock components, illustratively a spindle, the shell having an annular key way at the front face; the shell has an enlarged head portion at the front and a reduced diameter cylindrical portion extending from the head portion to the rear of the shell; at least one longitudinally extending lug member is disposed on the outer periphery of the cylindrical portion; the at least one lug starts at the enlarged head and extends rearwardly a minor portion of the length of the shell; the lug has portions successively from the enlarged head consisting of straight top and side walls, inwardly tapering top and side walls, and diminishingly angled walls.

4 Claims, 2 Drawing Sheets

AXIAL PIN TUMBLER LOCK

REFERENCE TO RELATED APPLICATIONS

This application is a continuation-in-part of U.S. Ser. No. 07/835,145 filed Feb. 12, 1992, entitled "AXIAL PIN TUMBLER LOCK", which is to issue as U.S. Pat. No. D350,686 on Sep. 20, 1994.

BACKGROUND OF THE INVENTION

Inexpensive locks are used in a growing number of environments. In many of these cases, to reduce cost and simplify installation, it is desirable to have a lock shell which can press fit into the panel or wall where the lock will be mounted. Accordingly, a lock shell that can be press fit into a hole or other opening in this manner is highly desirable.

SUMMARY OF THE INVENTION

In order to meet the object of providing a lock shell that can be easily press fit into an opening, there is provided according to the invention a lock shell comprising a tubular outer shell for receiving lock components, illustratively a spindle, the shell having an annular key way at the front face. The shell has an enlarged head portion at the front and a reduced diameter cylindrical portion extending from the head portion to the rear of the shell. At least one longitudinally extending lug member is disposed on the outer periphery of the cylindrical portion. The at least one lug starts at the enlarged head and extends rearwardly a minor portion of the length of the shell. The lug has portions successively from the enlarged head consisting of straight top and side walls, inwardly tapering top and side walls, and diminishingly angled walls. A lock shell according to the invention is inexpensive, easy to install, and has advantageous functional features.

DETAILED DESCRIPTION OF THE PREFERRED EMBODIMENTS

Figure 1:
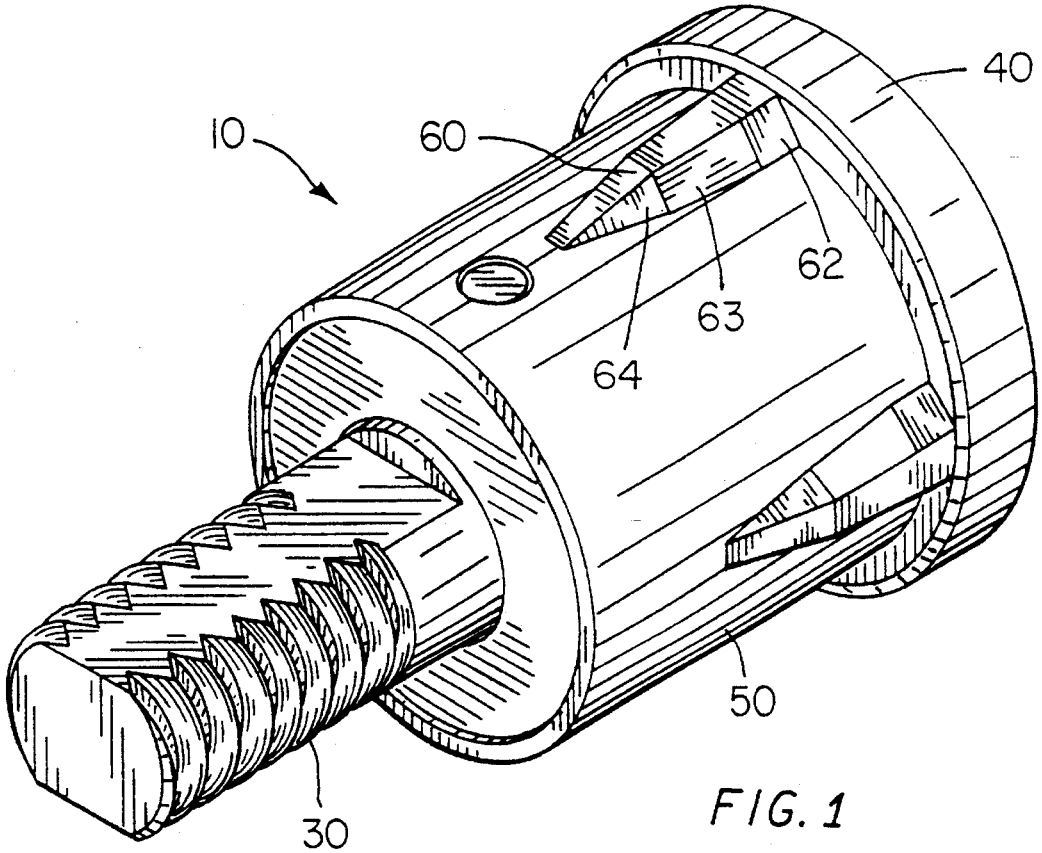
FIG. 1 is a rear perspective view of the lock shell according to the invention.
Figure 2:
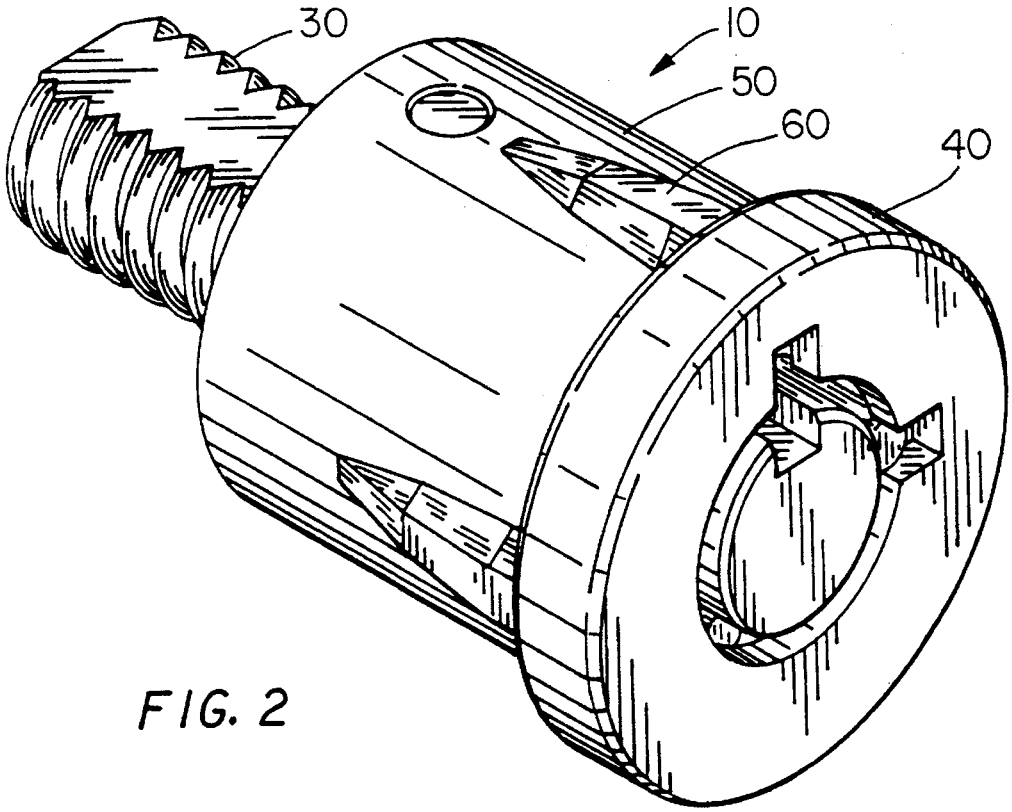
FIG. 2 is a front perspective view of the lock shell according to the invention.

Referring now to FIGS. 1–4, a lock shell 10 according to the invention is shown. In the embodiment shown, the lock shell 10 houses a spindle 30. Other internal lock components could be used in combination with the lock shell 10, and spindle 30 is shown for illustrative purposes only. Lock shell 10 includes an enlarged head portion 40. Extending rearwardly from the enlarged head portion 40 is a reduced diameter cylindrical portion 50. The lock shell 10 also includes at least one longitudinally extending lug member, designated in the FIGS. as 60. The lug member is disposed on the outer periphery of the reduced diameter cylindrical portion 50. Further, the lug 60 starts at the enlarged head and extends rearwardly for a minor portion of the length of the shell. As used herein, a minor portion of the length is approximately half the length of the reduced diameter cylindrical portion 50.

Figure 3:
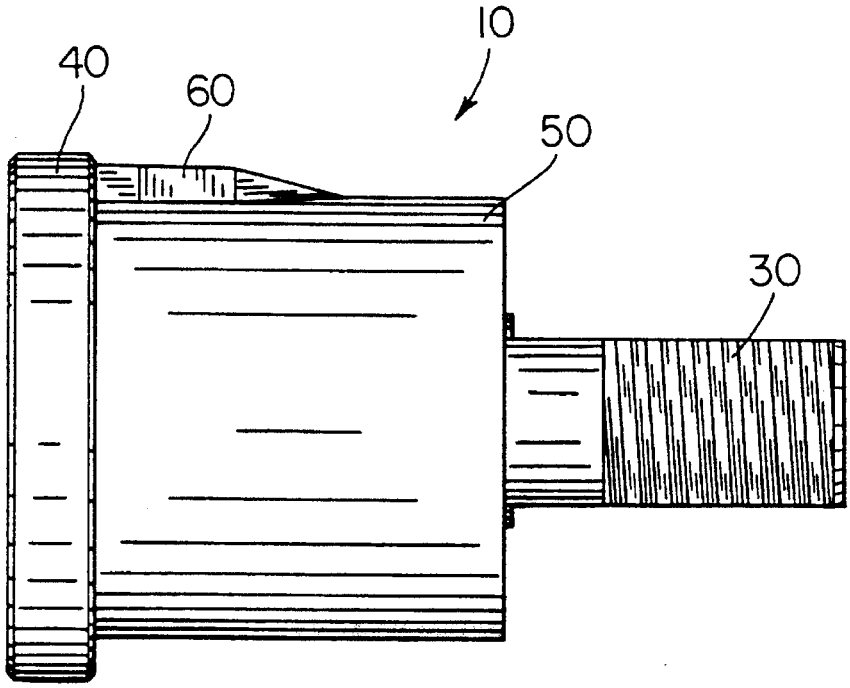
FIG. 3 is a side elevational view of the lock shell according to the invention.
Figure 4:
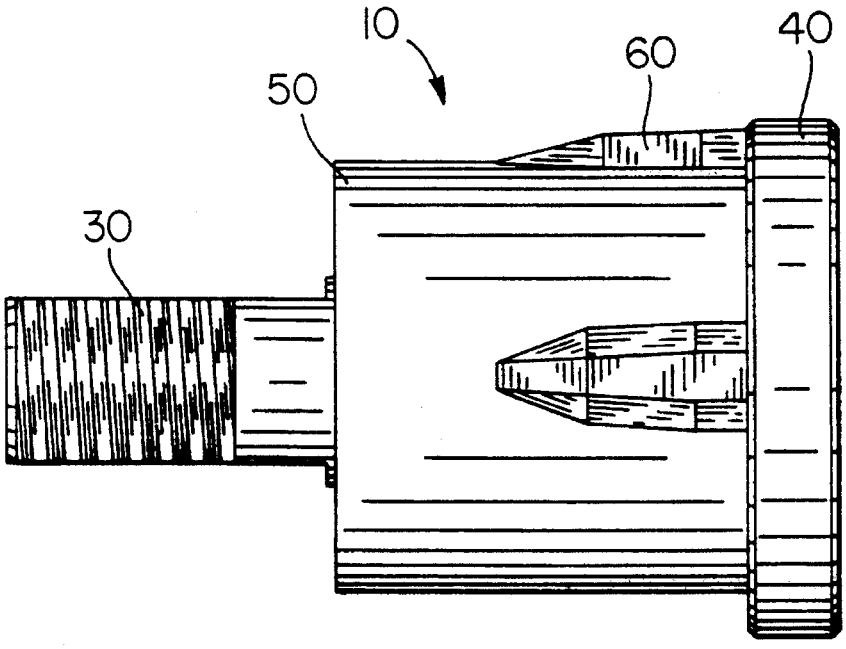
FIG. 4 is a top elevational view of the lock shell according to the invention.

As can been seen most clearly in FIGS. 1 and 3, the lug 60 has three successively joined portions 62, 63 and 64. Section 62 has straight (i.e. perpendicular) sidewalls, section 63 has tapering top and side walls, and section 64 has further diminishingly angled top and sidewalls with the top wall tapering downwardly to the reduced diameter cylindrical portion, and the sidewalls further tapering inwardly to the end of section 64.

As can be seen from the embodiment depicted in the drawings, the lock shell may include more than one lug, illustratively two lugs separated by 90° on the reduced diameter cylindrical portion 50.

A lock shell made according to this invention is simple in construction, and has the advantageous functional features referred to above.

What is claimed is:

1. A lock shell for press fitting into an aperture comprising a tubular outer shell for receiving a spindle and presenting a key way at the front face of the lock shell, said shell having an enlarged head portion at the front and a reduced diameter cylindrical portion extending from the head portion to the rear of the shell, at least one longitudinally extending lug member on the outer periphery of the reduced shell portion, the at least one lug member starting at the enlarged head and extending continuously rearwardly a minor portion of the length of the shell, said at least one lug member extending from the enlarged head and having continuous successive portions, each portion comprising a top wall and side walls, the top walls of the successive portions tapering downwardly toward the reduced diameter cylindrical portion, and the side walls of the successive portions tapering inwardly as the at least one lug member extends rearwardly.

2. A lock shell according to claim 1, where there are two lug members disposed 90° apart on the shell.

3. A lock shell according to claim 1, where the lug members extend about ½ the length of the shell.

4. A lock shell according to claim 1, where the at lest one lug member successively straight, tapered and diminishing portions are three distinct sections.

* * * * *